United States Patent [19]

Vogt et al.

[11] Patent Number: 4,990,888

[45] Date of Patent: Feb. 5, 1991

[54] UNITARY ALARM SENSOR AND COMMUNICATION PACKAGE FOR SECURITY ALARM SYSTEM

[75] Inventors: William R. Vogt, Rockaway; Leonard Noonan, Stanhope, both of N.J.; John E. Seeley, Warminster, Pa.

[73] Assignee: Baker Industries, Inc., Parsippany, N.J.

[21] Appl. No.: 832,624

[22] Filed: Feb. 25, 1986

[51] Int. Cl.[5] ..... G08B 29/00; G08B 26/00

[52] U.S. Cl. ..... 340/506; 340/505; 340/518; 340/825.06; 340/541; 340/547; 340/545; 340/693; 439/387

[58] Field of Search ..... 340/506, 505, 541, 545, 340/547, 546, 568, 571, 572, 693, 518, 825.06; 339/97 P, 97 R, 98, 193 P, 65, 74, 75, 395; 335/205; 403/354; 439/387, 388, 389

[56] References Cited

U.S. PATENT DOCUMENTS

| | | | |
|---|---|---|---|
| 2,916,733 | 12/1959 | Hirsch | 340/568 |
| 3,544,987 | 12/1970 | McMann, Jr. et al. | 340/547 |
| 3,833,895 | 9/1974 | Fecteau | 340/505 |
| 4,138,674 | 2/1979 | Humphries | 340/506 |
| 4,148,019 | 4/1979 | Durkee | 340/693 |
| 4,367,458 | 1/1983 | Hackett | 340/505 |
| 4,410,229 | 10/1983 | Stephenson | 339/97 P |
| 4,498,723 | 2/1985 | Johnston | 339/97 P |
| 4,542,372 | 9/1985 | Takach, Jr. | 340/500 |

*Primary Examiner*—Donnie L. Crosland
*Attorney, Agent, or Firm*—James J. Jennings

[57] ABSTRACT

A security alarm system includes a transponder having a housing enclosing both a sensor and associated circuit means in a unitary package. The housing base includes barrel-shaped connectors, and a pc board carrying the communications components is carried by the housing cover. Flag-like connectors mate with the barrel-shaped connectors when the cover is attached to the base, and the connectors give both good mechanical indexing and retention, and effective electrical contact. Removal of the cover from the base breaks the electrical contact and thus breaks continuity back to the system controller, indicating someone has tampered with the system.

15 Claims, 2 Drawing Sheets

TRANSPONDER
70

UNITARY ALARM SENSOR AND COMMUNICATION PACKAGE FOR SECURITY ALARM SYSTEM

BACKGROUND OF THE INVENTION

The present invention is directed to security alarm systems, and more particularly of the type employing sensors for providing an indication of the displacement of components such as doors, windows and so forth.

Various types of security alarm systems have been implemented to detect and signify the unauthorized opening of a window, door, or other entry-exit opening. Often such arrangements include a sensor, such as a reed switch, on one component part of the door or window, and a magnet affixed to another component of the door or window. A pair of wires intercouples the reed switch or contact set with a controller, and the magnet is positioned to hold the reed switch closed when the two relatively displaceable elements are in the closed (secure) position. When the one element is displaced, the magnetic force is removed or substantially weakened in the area of the reed switch, which then opens to provide an indication over the conductor pair to the controller that the window or door has been opened. This conventional arrangement suffers from several drawbacks.

One shortcoming is that from the standpoint of a would-be burglar, such arrangements are not very difficult to circumvent. Intruders have become adept at breaking a window and then shorting the conductors leading to the reed switch, to maintain the secure indication even when the window is thereafter opened.

Another drawback of earlier systems with multiple sensors (including contact pairs) on the same conductor pair is that the controller does not recognize which sensor has gone into alarm. Various attempts to solve this problem have been made, including providing a transponder assembly for one or more sensor points to provide addressability—denoting the location(s) of the sensors in alarm. The transponder has been housed in a separate enclosure, leading to a more costly and complex wiring arrangement to achieve addressability, especially when a plurality of sensors are attached to a single transponder.

Another deficiency is that the described arrangements for addressability have been costly, requiring three separate components: the magnet, the reed switch or other sensor, and a transponder coupled between the reed switch and the controller, for incorporating a specific address denoting the physical location of a given sensor and facilitating communication between the controller and the transponder. Not only is such an arrangement costly, but the components may degrade the aesthetics of the room decor. Frequently architectural specifications militate against placing the units in the most desirable locations, and this is another drawback.

It is therefore a principal consideration of the present invention to provide a security system with an enhanced protective level, by adding new levels of complexity to thwart the would-be intruder.

Another important consideration is to provide addressability in a security system at reduced cost, with simplified installation.

Another important consideration is to provide an effective cost reduction in such security systems.

Still another significant consideration is to provide an improved security system which is more pleasing from an aesthetic standpoint.

SUMMARY OF THE INVENTION

The present invention is particularly useful with a security alarm system of the type in which the controller communicates over a pair of conductors with various separately addressable transponders. Each transponder includes circuit means for communicating with the controller, and at least one of the transponders includes a sensor.

In accordance with a significant aspect of the present invention, each transponder having a sensor is provided with a housing for substantially enclosing both the circuit means and the sensor in a unitary package. This unitary package is approximately the same size and shape as those presently available enclosures which contain only a sensor.

Another important consideration is that the package is sufficiently small so that the unauthorized intruder can not discern, from the size and location of the package, whether the enclosure contains merely the usual reed switch or, as with the present invention, both the sensor assembly, alarm detection circuitry, tamper sensing circuitry, and the electronic circuit means for communicating between the controller and the sensor assembly.

Another important aspect of the invention is a cost-effective system for electrically intercoupling the separate components when they are assembled into a unitary package, especially in an enclosure where space is at a premium and reliable electrical connections are required.

THE DRAWINGS

In the several figures of the drawings like reference numerals identify like components, and in those drawings.

PRIOR ART ARRANGEMENTS

Figure 1:
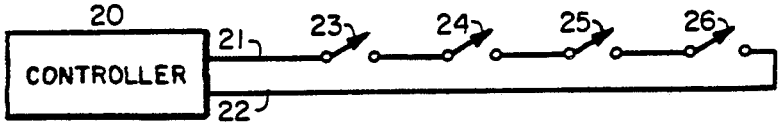
FIGS. 1-3 are simplified block diagrams useful in understanding known security alarm systems.
Figure 2:
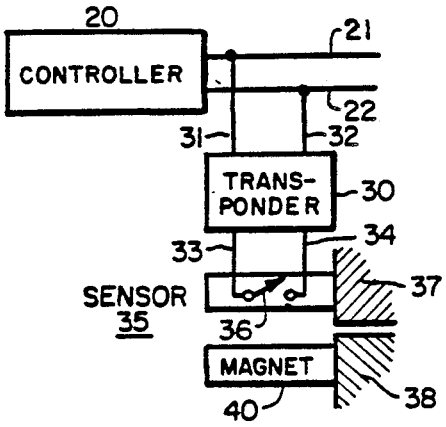

FIG. 1 depicts a simple arrangement in which a controller 20 is coupled over a pair of conductors 21, 22 to a series-connected sequence of detectors or contact sets 23, 24, 25 and 26. Those skilled in the art will appreciate that the conductor pair need not comprise a pair of solid electrical conductors of copper wire or like material, but can also be fiber optic paths with a communication of information by light waves, or air or other paths for passing signals. In general then "conductor pair" refers to a path for the transmission of signals between controller 20 and a series of detectors or switches connected to the conductor pair. The detectors or contact sets 23–26 can be simple switches which are opened or closed as an associated component such as window portions or a door-and-jamb arrangement are similarly opened and closed. In addition such contact sets can represent ionization or obscuration detectors for use in life protection systems for detecting particles of combustion and actual combustion, or systems other than contact sets for detecting entry and/or movement within confined spaces in a security system. In the system of FIG. 1, when any one of the contact sets 23–26 opens—if all are initially closed—then the controller only "knows" that there is an interruption somewhere on the conductor line 21, 22. It is frequently necessary to provide more accurate identification of the precise location at which the alarm condition or other occurence signified by a contact set opening occurs, and this led to the arrangement depicted in FIG. 2.

In an attempt to identify the precise location of the switch opening, a transponder 30 was provided and coupled over lines 31, 32 to the conductor pair 21, 22 for communication to the controller 20. The transponder contained circuitry to recognize its own "address" or identifying signal from the controller, and also to receive information over its associated conductors 33, 34 which are coupled to a sensor assembly 35 denoting the position of contact set 36 within the sensor assembly. Sensor assembly 35 is affixed (by screws or other suitable means, not shown) to a first component 37, which can be part of a door or window assembly. Another component 38 represents another part of the door or window assembly, and a magnet 40 is affixed to the second component 38. Thus when the two components are in the side-by-side position as shown, the strength of the field provided by magnet 40 maintains contacts at 36 in the closed position, indicating a secure position. Responsive to relative movement between components 37 and 38, the magnet 40 is displaced away from contact set 36, and the field strength adjacent the contact set is reduced sufficiently so that the contact set opens. This indication is provided over conductors 33, 34 to the transponder, which then communicates (or is communicated to by the controller) to indicate the contact set of the sensor 35 has opened. This is an effective way to identify the location of the contact set opening, but the cost is substantial because the transponder houses the communication and alarm detection system in a housing completely separate and independent of the sensor assembly and the magnet unit. Such a system entails additional installation expense and thus has militated against widespread employment of such an arrangement.

Figure 3:
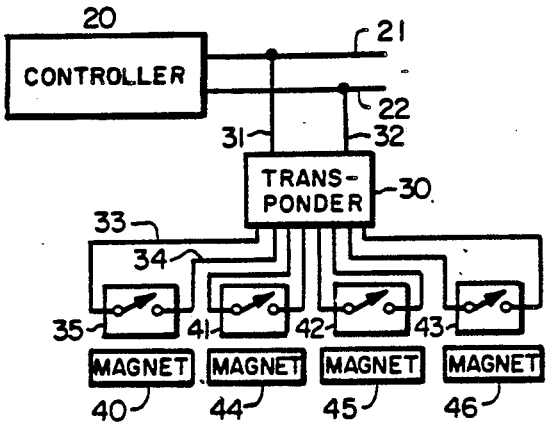

FIG. 3 depicts one effort to reduce the expense attendant upon using transponder 30 to identify the location of the contact set opening. In this arrangement three additional sensor assemblies 41, 42 and 43 are provided, each with their respective magnets 44, 45 and 46 or other auxiliary units positioned to have some condition detected by the contact set in the associated sensor assembly. Each sensor assembly is individually coupled over a pair of conductors to transponder 30. Thus when the contact set in any of the sensor assemblies 35, 41, 42 and 43 opens, an indication is transmitted over the intercoupled wire set to transponder 30, providing either direct transmission of a signal to the controller or a local storing of a contact-open event for subsequent determination by the controller as it polls the transponders in the group. By utilizing the transponder for its addressability and communication capabilities in connection with four separate sensor-magnet arrangements, the cost of the addressability by employing the transponder is reduced by the number of sensor-magnet assemblies added to that transponder. In this case the cost is only 25% per each sensor-magnet arrangement as contrasted to the system depicted in FIG. 2. However the system of FIG. 3 still suffers from the shortcomings that the transponder for monitoring four sensor-magnet arrangements is large, and the transponder may not be capable of monitoring different sensor-magnet pairs spaced at a distance from the transponder. Sometimes only one or two sensor-magnet pairs are within the physical proximity of a transponder capable of sensing four such units, and this less-than-100% usage of the transponder is wasteful. Accordingly there is still substantial room for improvement over these described earlier systems.

DETAILED DESCRIPTION OF THE INVENTION

Figure 4:
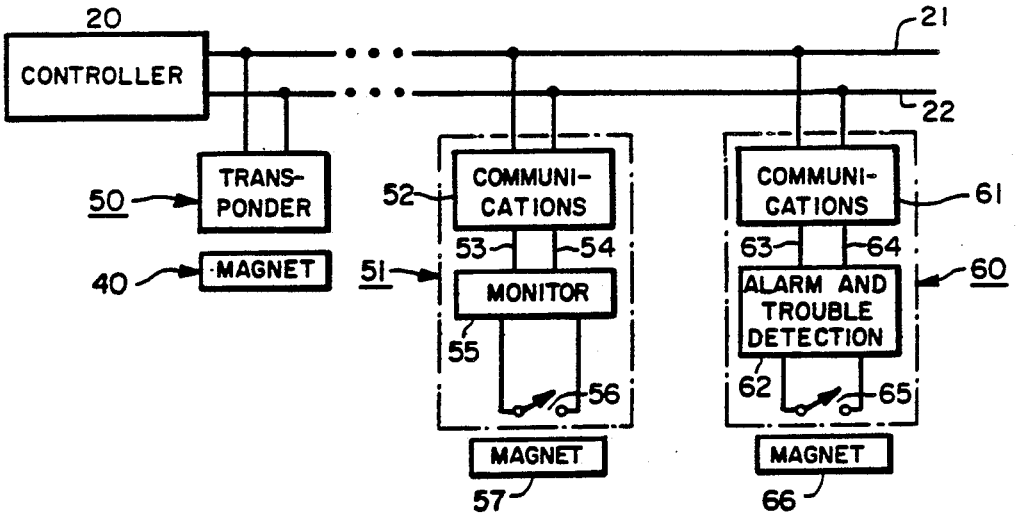
FIG. 4 is a block diagram of a security system in which the present invention is useful.

FIG. 4 depicts in block diagram one arrangement for intercoupling various transponders in accordance with the teaching of the present invention. As there shown a first transponder 50 is coupled to the conductor pair 21, 22, and a magnet 40 is positioned adjacent transponder 50. However the transponder may include different communication and other networks, as shown in FIG. 4. By way of example, tranponder 51 includes a communications circuit 52 coupled to the conductor pair 21, 22, and a monitor circuit coupled over conductors 53, 54 to communications circuit 52. In turn a sensor 56, depicted as a contact set, is coupled to the monitor circuit 55. A magnet 57 is positioned next to transponder 51. Although depicted as a simple contact set, it is evident that sensor 56 can be utilized as any type of detector and/or sensor to provide a signal over the monitor circuit, for communication through circuit 52 with controller 20. More specifically, the term "monitor" as used herein and in the appended claims embraces the following functions, and implies that at least one of these functions is present in the monitor circuit:

(1) The translation of changes, whether large, step-function type changes or minute, incremental changes of the sensor position or conditions adjacent the sensor into an electrical signal;

(2) translation of a change in the sensor itself into an electrical signal, denoting an alarm condition;

(3) translation of a malfunction in the sensor and/or an alarm and trouble detection circuit associated with the sensor into an electrical signal which denotes a trouble condition; and (4) translation of the relative condition of the sensed transducer (for example, the linear output signal of a Hall effect transducer) into an electrical signal.

Another transponder 60 includes a communication circuit 61 coupled to the conductor pair 21, 22, and an alarm and trouble detection circuit 62 coupled over conductors 63, 64 to the communication circuit. A sensor 65, shown as a simple contact set, is coupled to alarm and trouble detection circuit 62. A magnet 66 is disposed adjacent transponder 60. The alarm and trouble detection circuit 62 operates to send a signal to communication circuit 61 when sensor 65 opens and closes, and additionally operates to provide a trouble signal to communication circuit 61 when there is any malfunction either in the circuit including sensor 65 or in the alarm and trouble detection circuit itself, or in other parts of the transponder. Such circuits and system operation are now known and are described, for example, in U.S. Pat. No. 4,507,652, entitled "Bidirectional, Interactive Fire Detection System" which issued Mar. 26, 1985 in the name of William R. Vogt and John M. Wynne, and is assigned to the assignee of this application. Accordingly no further description of the system operation and communication protocol will be set out in this application.

While the communication system is shown as operating over a conductor pair 21, 22, generally a pair of separate electrial conductors, those skilled in the art will appreciate that the transmission path can be over a co-axial cable, fiber optic path, air, or other communication medium.

Figures 5, 6, 7, 8:
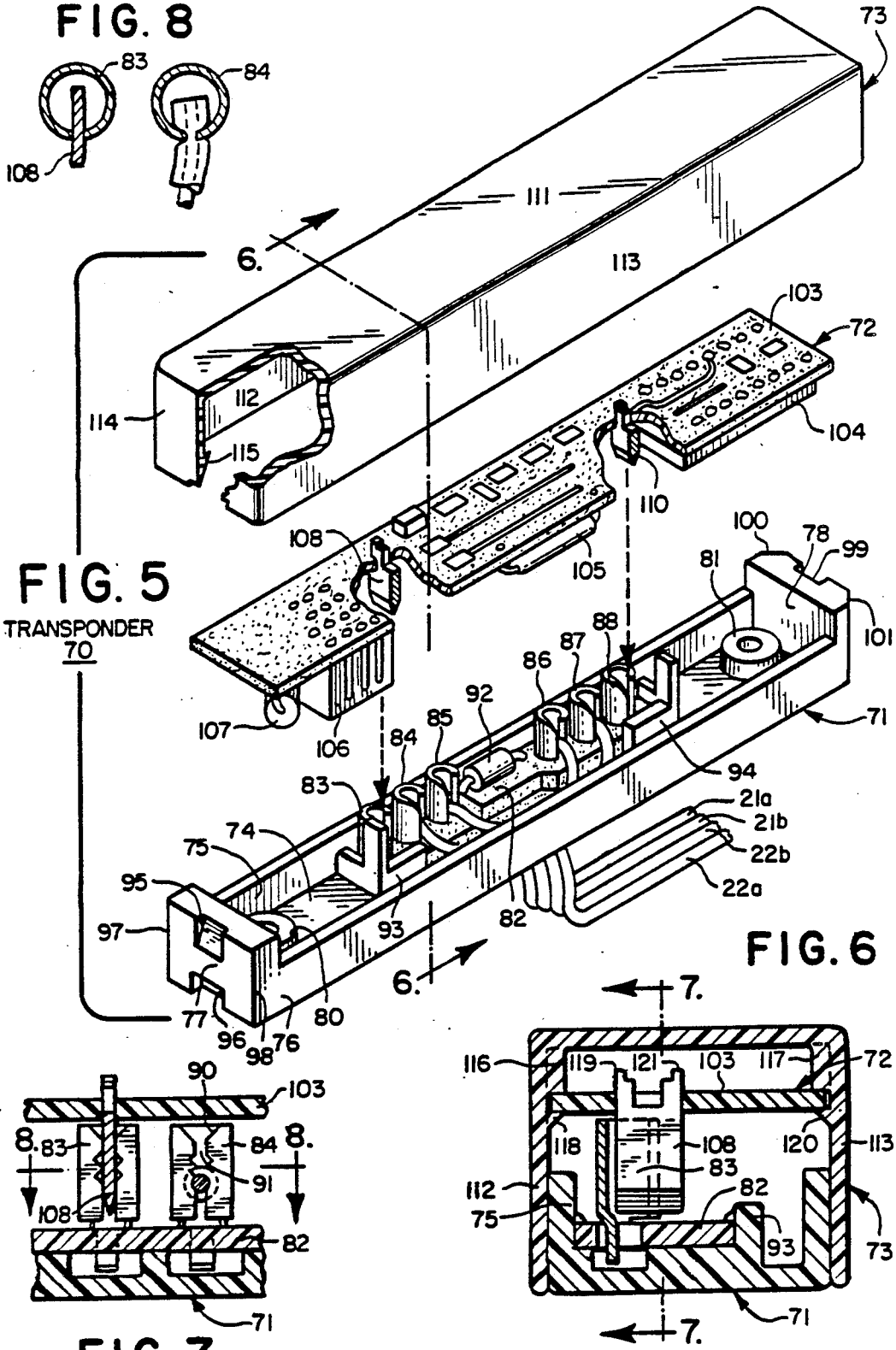
FIG. 5 is an exploded perspective view depicting the individual components which, when mated, provide the unitary enclosure which is an important feature of the present invention.
FIG. 6 is a sectional view, on a scale enlarged With respect to the scale of FIG. 5, taken along the line 6—6 of FIG. 5, illustrating the housing components in the closed position.
FIG. 7 is sectional view, taken along the line 7—7 of FIG. 6, particularly useful in illustrating an important feature of the present invention.
FIG. 8 is a sectional showing, taken along the line 8—8 of FIG. 7, which further assists in illustrating this feature.

Considering now the structure of a transponder itself, FIG. 5 shows that a typical transponder assembly 70 is actually comprised of four separate components; a base housing 71, on which a base printed circuit (pc) board 82 is located; a sensor assembly unit 72; and a cover housing 73. When assembled the four components fit in the space occupied by cover 73 and this is approximately the physical size of present units which merely include a magnet or a reed switch sensor. Base unit 71 includes a floor portion 74, a pair of side walls 75, 76 and a pair of end walls 77, 78. While the portions are described separately, in a preferred embodiment the unit is formed by injection molding, and thus the various components depicted are integral with one another. A pair of pillars 80, 81 extend upwardly from the floor and these pillars each define a central bore for receiving a mounting screw (not shown) or other fastener used to affix base unit 71 to the window, door or other adjacent component, in an obvious manner. The pc board 82 is attached to floor 74 of the base unit, and a series of six insulation displacement connectors 83–88 are mounted on this board. Such connectors are conventional barrel-shaped connectors with, as better shown in FIG. 7, a tapered throat portion 90 and a central channel 91.

In FIG. 5 a surge supressor 92 is also mounted on pc board 82. Conductors 21*a*, 21*b*, 22*a* and 22*b* are shown extending through an aperture (not visible in this view) in floor portion 74 for electrical connection to the insulation displacement connectors 84–87 as indicated. The connectors effect the function represented by conductors 21, 22 in FIGS. 2–4, in that two of the conductors extend from the last transponder to the illustrated transponder 70 and the other two conductors extend onward to the next transponder. Connectors 83, 84 and 85 are all electrically connected together through pc board 82, and similarly connectors 86–88 are also connected to each other.

A pair of right-angle pillars or spacers 93, 94 extend upwardly as shown from floor portion 74 and above the top of the side walls 75, 76 of the base unit. These pillars act as spacers to provide an interference fit for the adjacent components when the transponder is assembled as will be explained.

End wall 77 defines a notch 95 at its top, and an extended recess 96 at its base portion. The corners 97 and 98 are squared off as shown. The other end wall 78 also defines a notch 99 at its top portion. In this end wall both corners 100, 101 are chamfered or beveled to define a keyway. This double-chamfer provides a configuration different from that of the other end wall, which has square corners 97 and 98, affording correct mating engagement with the cover portion.

Intermediate unit 72 is comprised of another pc board 103, which will be termed the cover pc board. A custom integrated circuit 104 is affixed under a portion of pc board 103. Circuit 104 provides the "intelligence" and other functions in a manner similar to that of the component IC1 shown in FIG. 8 of the above identified patent. A sensor 105 is affixed to the board 103. This sensor can be a reed switch or other sensing arrangement. An address shunt assembly 106 is affixed to, and extends below, board 103 as shown. This assembly includes the function of setting the address of transponder 70, in a manner similar to that effected by address select switches 66 shown in FIGS. 7 and 8 of the above identified patent. A capacitor 107 is also affixed to pc board 103.

In accordance with a significant aspect of the invention, a pair of spaced apart flag-like connectors 108, 110 are connected to board 103 and extend below this board, toward the two outermost barrel-shaped connectors 83 and 88. The extremities of connectors 108 and 110 below board 103 are tapered to provide ready insertion and guiding into the throat portions of the insulation displacement connectors. This will become apparent in the description of the subsequent drawings.

Cover unit 73 has a top portion 111, a pair of side walls 112 and 113, and a pair of end walls, only of of which (114) is evident in this showing. A wedge or lip portion 115 of end wall 114 extends inwardly toward the hollow center of cover 73. A similar lip (not visible) is provided on the interior of the other end wall of the cover, so that when the cover is mated to the base unit, the wedge-shaped lips are received in the corresponding recesses (such as 96 in the left end of the base) to secure the cover and base units. Notch 95 insures accurate guiding of the wedge 115 during the insertion process. Other details of the cover are better seen in FIG. 6.

As there shown, in certain interior portions the upper side walls of cover 73 include respective shelf portions 116, 117. These shelves act as stops so that when the cover pc board 103 is inserted into cover 73, proper alignment of board 103 is assured. A pair of locking tabs 118, 120 are provided on the side walls in the proper position to secure pc board 103 when it is moved into its desired position.

Also evident in FIG. 6 is the mounting of flag connector 108 in board 103. While a pair of legs 119, 121 extend from the flag connector into the board, it is also possible to provide a single leg or extend the width of leg 121, if additional support is needed. As shown the flag extends into the slit of connector 83, the back portion of which extends downwardly into pc board 82 to establish a good connection and provide mechanical support on this board. The pillars or spacers 93, 94 visible in FIG. 5, but not in FIG. 6, regulate the minimum spacing of pc board 103 relative to the tops of connectors 83–88 when the cover assembly 73, 72 is mated to the base 71; this spacing is evident in FIGS. 6 and 7. The extent to which flag connectors 108 extend below the board and into connector 83 is regulated by the interference fit, and is also visible in FIG. 7.

In the view of FIG. 7 the normal function of an insulation displacement connector such as 84 is evident. When an insulated electrical conductor is inserted into the throat portion 90 of the connector and then pushed downwardly through channel 91, the insulation layer is severed and the interior conductor establishes a good electrical connection with the connector 84. This type of connector has been known and used.

In contradistinction, use of the flag connector 108 in conjunction with a displacement connector has not been known. The slit or channel 91 of each of the barrel-shaped connectors has a width of a reference dimension. The thickness of each flag connector 108 is made to exceed such reference dimension, by an amount less than that which would cause extensive mechanical distortion of the barrel-shaped connectors, so that when inserted into the slit 91 the barrel is significantly spread, and there is a substantial wiping action of the flag connector in the barrel. This provides not only a very good electrical connection but also highly effective mechanical retention of the flags by the barrel-shaped connectors. In addition the tip of each flag is tapered to a dimension less than the reference dimension of the barrel connector, thus affording ready insertion of the flag into the barrel slit. The nominal slit width is usually about 10 mils (a mil is 0.001 inch) in the unsprung condition of the barrel connector. The width of the flag connector was made about 35 mils to insure a good connection, and the point of each flag connector is also tapered down to about 5 mils to afford the ready insertion. This is also evident in FIG. 8, which shows both the insertion of a flag connector 108 into one connector 83, and further illustrates how the insulation portion of an adjacent conventional conductor is severed in the usual employment of a displacement connector.

PC board 82 is installed in base 71 at the factory, and the other board 72 is likewise inserted into the cover portion 73 at the factory. Thus when the transponder is ready for assembly, the address is set in assembly 106 of the center unit 72, and the electrical connections are made from the four conductors through the base 71 to the barrel connectors 84–87. The cover assembly (including pc board 103 and cover 73) is then mated with the base unit by pushing downwardly so that the wedges (such as 115) are aligned by the notches (such as 95), and moved additionally until the lips 115 are seated as already described. The spacers 93, 94 assure that the pc board 103 is not pushed downwardly beyond the desired distance. Insertion of the flag connectors into the barrel connectors provides not only effective electrical connection but also very good structural support for the resultant assembly.

TECHNICAL ADVANTAGES

The present invention has added a new level of complexity to foil lawbreakers. With prior systems the intruder could readily short the reed switch, whereas the invention includes intelligence built into the transponder unit. Removal of the cover of the inventive assembly also removes the board with the reed switch; only the base remains attached to the wall. Cover removal breaks the continuity back to the controller and that break is detectable. The controller recognizes that the cover has in fact been removed, due to the interruption in communication between the transponder and the controller. The system cost and installation complexity have been reduced because the sensor or reed switch has been combined with the electronics, which may include alarm and trouble detection as well as communication, within a single, compact enclosure. The only other component required is the auxiliary unit or magnet on the movable part of the window or door. Previously the electronics were in a separate assembly and package, necessitating the use of three assemblies instead of two.

The use of only two components is less costly to purchase and install, as well as being less intrusive on the decor and thus more pleasing from an aesthetic viewpoint. With previous arrangements an additional box housing the electronics was placed on the wall or ceiling, and architects and designers have found it difficult to accommodate such additional components within an original design framework.

Another important advance is the effective mechanical alignment and electrical interconnection achieved with the flag-type connectors inserted into the barrels of the insulation displacement connectors. There is a very good wiping action as the flag enters the barrel slit, establishing a good connection every time. Both members (flag and barrel) are structurally sound, and not easily distorted by accident prior to mating; the members are tolerant to misalignment during insertion, because the Y-shaped throat of the barrel guides the wedge-shaped flag, making insertion simple. The resultant physical connection is very strong and the components are not easily bent.

In the appended claims the term "connected" (when used in an electrical or electronic sense) means a d-c connection between two components with virtually zero d-c resistance between those components. The term "coupled" indicates there is a functional relationship between two components, with the possible interposition of other elements (or air) between the two components described as "coupled" or "intercoupled".

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A security alarm system for monitoring at least two relatively movable components in which a controller communicates with at least two separately addressable transponders, at least one of the transponders including at least one sensor transducer, each transponder including circuit means for communicating between the sensor transducer and the controller, at least one transponder having a housing comprised of a cover and a base and substantially enclosing both the circuit means and the sensor transducer in a unitary package, an auxiliary unit positioned on one of said components such that, responsive to relative movement between the components, the sensor transducer produces a signal denoting such relative movement, said base and cover including means for establishing an electrical connection when the base and cover are mated, to identify separation of the base and cover by interruption of the electrical connection, said means for establishing the electrical connection between the base and cover including at least one cylindrical female connector defining a slit therein and supported on the base, and at least one flag-like connector supported on the cover in a position such that when the cover and base are assembled, the flag-like connector is received in the slit of the cylindrical female connector to provide both mechanical indexing and retention, and effective electrical contact.

2. A security alarm system as claimed in claim 1, and further comprising a support board carried by the cover, which support board carries said flag-like connector for insertion into said female connector.

3. A security alarm system as claimed in claim 1, and further comprising a support board carried by the base, which support board carries said cylindrical female connector, which connector defines the slit therein for receiving the flag-like connector.

4. A security alarm system as claimed in claim 1, and further comprising a first support board carried by the cover, said flag-like connector and an additional flag-like connector mounted on the first support board and spaced apart by a given distance, a second support board carried by the base, and said cylindrical female connector and an additional cylindrical female connector carried by the second support board and spaced apart by said given distance, each of said cylindrical female connectors defining a slit for receiving one of the flag-like connectors when the cover is assembled to the base.

5. A security alarm system as claimed in claim 4, in which a pair of spaced-apart pillars extend from the base toward the first support board carried by the cover, which pillars are of a height to provide the desired distance between the first and second support boards.

6. A security alarm system as claimed in claim 4, in which the slit in each cylindrical female connector has a width of reference dimension, and each flag-like connector has a thickness exceeding said reference dimension, to insure good electrical contact between the flag-like connector and female connector and provide effective mechanical retention of the flag-like connector in the female connector.

7. A security alarm system as claimed in claim 6, in which each flag-like connector has a tip portion tapered to a dimension less than said reference dimension to afford ready insertion of the flag-like connectors into the slits of the cylindrical female connectors.

8. A security alarm system for monitoring at least two relatively movable components in which a controller communicates over a pair of conductors with at least two separately addressable transponders, at least one of the transponders including at least one sensor transducer, each transponder including circuit means for communicating between the sensor transducer and the controller, at least one transponder having a housing comprised of a cover and a base and substantially enclosing both the circuit means and the sensor transducer in a unitary package, an auxiliary unit positioned on one of said components such that, responsive to relative movement between the components, the sensor transducer produces a signal denoting such relative movement, said base and cover including means for establishing an electrical connection when the base and cover and mated, to identify separation of the base and cover by interruption of the electrical connection, said means for establishing the electrical connection between the base and cover including at least one cylindrical female connector defining a slit therein and supported on the base, and a flag-like connector supported on the cover in a position such that when the cover and base are assembled, the flag-like connector is received in the slit of the cylindrical female connector to provide both mechanical indexing and retention, and effective electrical contact.

9. A security alarm system as claimed in claim 8, and further comprising a support board carried by the cover, which support board carries said flag-like connector and an additional flag-like connector for insertion into respective female connectors.

10. A security alarm system as claimed in claim 8, and further comprising a support board carried by the base, which support board carries said cylindrical female connector and an additional cylindrical female connector, each defining a slit therein for receiving a flag-like connector.

11. A security alarm system as claimed in claim 8, and further comprising a first support board carried by the cover, said flag-like connector and an additional flag-like connector mounted on the first support board and spaced apart by a given distance, a second support board carried by the base, and said cylindrical female connector and an additional cylindrical female connector carried by the second support board and spaced apart by said given distance, each of said cylindrical female connectors defining a slit for receiving one of the flag-like connectors when the cover is assembled to the base.

12. A security alarm system as claimed in claim 11, in which the slit in each cylindrical female connector has a width of reference dimension, each flag-like connector has a thickness exceeding said reference dimension, and each flag-like connector has a tip portion tapered to a dimension less than said reference dimension to afford ready insertion of the flag-like connectors into the slits of the cylindrical connectors.

13. A transponder assembly for use in a security alarm system in which a controller communicates with separately addressable transponders, said transponder assembly including at least one circuit board, a sensor transducer mounted on said circuit board, circuit means, mounted on said circuit board, for communicating between the sensor transducer and the controller, a unitary housing, including a cover and a base, substantially enclosing the circuit board, the sensor transducer, and the circuit means, said base and cover including male and female connector means for establishing an electrical connection when the base and cover are mated, to identify separation of the base and cover by interruption of the electrical connection, in which the male connector means comprises a pair of flag-like connectors, spaced apart by a given distance, and said female connector means comprises a pair of cylindrical female connectors spaced apart by said given distance, each of said cylindrical female connectors defining a slit for receiving one of the flag-like connectors when the cover is assembled to the base.

14. A transponder assembly as claimed in claim 13, in which the slit in each cylindrical female connector has a width of reference dimension, and each flag-like connector has a thickness exceeding said reference dimension, to insure good electrical contact between a flag-like connector and a female connector.

15. A transponder assembly as claimed in claim 14, in which each flag-like connector has a tip portion tapered to a dimension less than said reference dimension to afford ready insertion of the flag-like connectors into the slits of the cylindrical female connectors.

* * * * *